US010830510B2

(12) United States Patent
Schreiber et al.

(10) Patent No.: US 10,830,510 B2
(45) Date of Patent: Nov. 10, 2020

(54) HEAT EXCHANGER FOR A VAPOR COMPRESSION SYSTEM

(71) Applicant: Johnson Controls Technology Company, Plymouth, MI (US)

(72) Inventors: Jeb W. Schreiber, Stewartstown, PA (US); Eric H. Albrecht, Dallastown, PA (US); Kevin D. Krebs, Dallastown, PA (US); Justin P. Kauffman, York, PA (US); Brian L. Stauffer, York, PA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 194 days.

(21) Appl. No.: 15/385,668

(22) Filed: Dec. 20, 2016

(65) Prior Publication Data

US 2017/0176063 A1 Jun. 22, 2017

Related U.S. Application Data

(60) Provisional application No. 62/270,164, filed on Dec. 21, 2015.

(51) Int. Cl.
*F25B 39/00* (2006.01)
*F25B 40/02* (2006.01)
(Continued)

(52) U.S. Cl.
CPC ..... *F25B 39/00* (2013.01); *F25B 40/02* (2013.01); *F28D 3/02* (2013.01); *F28D 3/04* (2013.01);
(Continued)

(58) Field of Classification Search
CPC .. F25B 40/02; F25B 39/04; F25B 6/04; F25B 25/005; F25B 2339/047; F25B 2400/13;
(Continued)

(56) References Cited

U.S. PATENT DOCUMENTS 1,233,138 A * 7/1917 Snow ..... F28B 1/02 165/114
1,922,843 A * 8/1933 Ehrhart ..... F28B 1/02 165/110
(Continued)

FOREIGN PATENT DOCUMENTS

CN 2236637 Y 10/1996
CN 2286303 Y 7/1998
(Continued)

OTHER PUBLICATIONS

PCT International Search Report & Written Opinion for PCT Application No. PCT/US2016/068124 dated Mar. 7, 2017, 12 pgs.
(Continued)

*Primary Examiner* — Frantz F Jules
*Assistant Examiner* — Lionel Nouketcha
(74) *Attorney, Agent, or Firm* — Fletcher Yoder, P.C.

(57) ABSTRACT

Embodiments of the present disclosure relate to a vapor compression system that includes a refrigerant loop, a compressor disposed along the refrigerant loop and configured to circulate refrigerant through the refrigerant loop, a condenser disposed downstream of the compressor along the refrigerant loop, where the condenser includes a plurality of tubes disposed in a shell and a diffusion area configured to enhance thermal energy transfer within the condenser, where the diffusion area is defined by a cavity of the condenser without a tube of the plurality of tubes, and an evaporator disposed downstream of the condenser along the refrigerant loop.

10 Claims, 9 Drawing Sheets

(51) Int. Cl.

| | |
|---|---|
| ***F28D 7/00*** | (2006.01) |
| ***F28D 3/04*** | (2006.01) |
| ***F28D 5/02*** | (2006.01) |
| ***F28D 3/02*** | (2006.01) |
| ***F28D 7/16*** | (2006.01) |
| ***F28F 9/02*** | (2006.01) |
| ***F28F 9/013*** | (2006.01) |
| ***F28D 5/00*** | (2006.01) |
| *F28D 21/00* | (2006.01) |
| *F25B 39/04* | (2006.01) |

(52) U.S. Cl.

CPC ..... *F28D 5/00* (2013.01); *F28D 5/02* (2013.01); *F28D 7/0066* (2013.01); *F28D 7/0091* (2013.01); *F28D 7/16* (2013.01); *F28D 7/163* (2013.01); *F28F 9/0131* (2013.01); *F28F 9/026* (2013.01); *F25B 39/04* (2013.01); *F25B 2339/021* (2013.01); *F25B 2339/0242* (2013.01); *F25B 2339/046* (2013.01); *F25B 2339/047* (2013.01); *F25B 2341/0662* (2013.01); *F25B 2400/13* (2013.01); *F25B 2400/23* (2013.01); *F25B 2500/01* (2013.01); *F25B 2500/13* (2013.01); *F25B 2500/18* (2013.01); *F28D 2021/007* (2013.01); *F28D 2021/0071* (2013.01); *F28F 2265/30* (2013.01)

(58) Field of Classification Search

CPC ..... F28D 3/02; F28D 3/04; F28D 5/02; F28D 7/1607

See application file for complete search history.

(56) References Cited

U.S. PATENT DOCUMENTS

| | | | | | |
|---|---|---|---|---|---|
| 2,919,903 | A * | 1/1960 | Vautrain | F28D 7/1646 | 165/110 |
| 4,208,529 | A | 6/1980 | Murray | | |
| 4,252,186 | A * | 2/1981 | Starner | F28F 9/22 | 165/114 |
| 4,437,322 | A * | 3/1984 | Ertinger | B23P 15/26 | 62/115 |
| 4,494,386 | A * | 1/1985 | Edwards | C09K 5/041 | 62/402 |
| 4,576,222 | A * | 3/1986 | Granata, Jr. | F28F 9/0278 | 165/134.1 |
| 5,113,928 | A * | 5/1992 | Myers | F28F 9/22 | 165/103 |
| 5,212,965 | A | 5/1993 | Datta | | |
| 5,509,466 | A * | 4/1996 | McQuade | F25B 39/04 | 165/112 |
| 5,996,356 | A | 12/1999 | Kishimoto et al. | | |
| 7,665,304 | B2 * | 2/2010 | Sundel | F01K 15/04 | 60/671 |
| 2009/0165497 | A1 * | 7/2009 | Welch | F25B 39/028 | 62/515 |
| 2009/0178789 | A1 * | 7/2009 | Luo | F25B 39/04 | 165/157 |
| 2010/0006264 | A1 | 1/2010 | Jadric et al. | | |
| 2010/0275643 | A1 | 11/2010 | Welch | | |
| 2010/0276130 | A1 * | 11/2010 | de Larminat | F25B 39/028 | 165/157 |
| 2013/0277020 | A1 | 10/2013 | Numata et al. | | |
| 2015/0007604 | A1 * | 1/2015 | Hu | F28F 9/028 | 62/507 |
| 2015/0226472 | A1 * | 8/2015 | Scherer | F25B 31/004 | 62/115 |

FOREIGN PATENT DOCUMENTS

| | | | |
|---|---|---|---|
| CN | 2735254 | Y | 10/2005 |
| CN | 1847768 | A | 10/2006 |
| CN | 201897348 | U | 7/2011 |
| CN | 201926338 | U | 8/2011 |
| CN | 102261772 | A | 11/2011 |
| CN | 202928174 | U | 5/2013 |
| CN | 102597680 | B | 6/2014 |
| CN | 105135914 | A | 12/2015 |
| JP | S5573176 | U | 5/1980 |
| JP | S61256194 | A | 11/1986 |
| JP | S63259363 | A | 10/1988 |
| JP | H04116358 | A | 4/1992 |
| JP | H08233408 | A | 9/1996 |
| JP | H110132400 | A | 5/1998 |
| JP | H110246595 | A | 9/1998 |
| JP | 2000274881 | A | 10/2000 |
| JP | 2003065631 | A | 3/2003 |
| JP | 2008298413 | A | 12/2008 |
| JP | 2012533284 | A | 12/2012 |
| WO | 2009089100 | A1 | 7/2009 |

OTHER PUBLICATIONS

PCT International Search Report & Written Opinion for PCT Application No. PCT/US2016/068106 dated Mar. 10, 2017, 14 pgs.
Japanese Notice of Allowance for JP Application No. 2018-551911 dated Dec. 3, 2019, 3 pg.
Korean Office Action for KR Application No. 10-2018-7019997 dated Nov. 19, 2019, 8 pg.
Chinese Office Action for CN Application No. 201680073025.1 dated Dec. 4, 2019, 15 pg.
Taiwan Office Action and Search Report for TW Application No. 105142497 dated Mar. 10, 2020, 9 pgs.
Korean Office Action for KR Application No. 10-2018-7019997 dated May 19, 2020, 2 pgs.
Chinese Office Action for CN Application No. 201680073025.1 dated Aug. 24, 2020, 6 pg.

* cited by examiner

HEAT EXCHANGER FOR A VAPOR COMPRESSION SYSTEM

CROSS REFERENCE TO RELATED APPLICATIONS

This application claims priority from and the benefit of U.S. Provisional Application Ser. No. 62/270,164, filed Dec. 21, 2015, entitled "VAPOR COMPRESSION SYSTEM," the disclosure of which is hereby incorporated by reference in its entireties for all purposes.

BACKGROUND

This application relates generally to vapor compression systems incorporated in air conditioning and refrigeration applications.

Vapor compression systems utilize a working fluid, typically referred to as a refrigerant that changes phases between vapor, liquid, and combinations thereof in response to being subjected to different temperatures and pressures associated with operation of the vapor compression system. Refrigerants are desired that are friendly to the environment, yet have a coefficient of performance (COP) that is comparable to traditional refrigerants. COP is a ratio of heating or cooling provided to electrical energy consumed, and higher COPs equate to lower operating costs. Unfortunately, there are challenges associated with designing vapor compression system components compatible with environmentally-friendly refrigerants, and more specifically, vapor compression system components that operate to maximize efficiency using such refrigerants.

SUMMARY

In an embodiment of the present disclosure, a vapor compression system includes a refrigerant loop, a compressor disposed along the refrigerant loop and configured to circulate refrigerant through the refrigerant loop, a condenser disposed downstream of the compressor along the refrigerant loop, where the condenser includes a plurality of tubes disposed in a shell and a diffusion area configured to enhance thermal energy transfer within the condenser, where the diffusion area is defined by a cavity of the condenser without a tube of the plurality of tubes, and an evaporator disposed downstream of the condenser along the refrigerant loop.

In another embodiment of the present disclosure, a condenser includes a shell, a plurality of tubes formed into one or more tube bundles, where the plurality of tubes are disposed within the shell, an inlet disposed on the shell and configured to direct vapor refrigerant from a compressor into the condenser, a tube plate disposed in the shell, where at least one tube of the plurality of tubes is configured to extend through the tube plate, and wherein the tube plate is configured to reduce vibrations of the at least one tube of the plurality of tubes.

In still another embodiment of the present disclosure, a vapor compression system includes a refrigerant loop, a compressor disposed along the refrigerant loop and configured to circulate refrigerant through the refrigerant loop, a condenser disposed downstream of the compressor along the refrigerant loop, where the condenser includes a plurality of tubes disposed within a shell and a passage lane configured to enhance thermal energy transfer within the condenser, where the passage lane is defined by a volume within the shell without a tube of the plurality of tubes, and an evaporator disposed downstream of the condenser along the refrigerant loop.

DETAILED DESCRIPTION

Embodiments of the present disclosure are directed towards an enhanced condenser that may be utilized in a vapor compression system. Specifically, the condenser may include a diffusion area that enables refrigerant within the condenser to contact a greater number of tubes at a point within the condenser where the refrigerant has its highest temperature. Additionally, the diffusion area may provide a greater volume for the refrigerant to diffuse (e.g., spread out axially and radially) within the condenser, thereby reducing a pressure drop within the condenser (e.g., between a space where the refrigerant flows into the condenser and ends of the condenser). Accordingly, an amount of thermal heat transfer between the refrigerant and a cooling fluid flowing through the tubes may increase, thereby increasing an efficiency of the condenser. Increasing the efficiency of the condenser may enable a number of tubes within the condenser to be reduced (i.e., and still achieve a target cooling capacity), which may reduce costs.

Additionally, the diffusion area may provide the greater volume for the refrigerant to diffuse, which may reduce a velocity of the refrigerant that contacts the tubes. The reduced velocity of the refrigerant may reduce vibrations caused by a flow of the refrigerant within the condenser. In addition, some embodiments of the condenser may include a tube plate that may receive one or more tubes of the condenser to reduce vibration of the tubes in the condenser by providing additional structural support to the tubes. In some cases, vibration of the tubes in the condenser may ultimately cause the tubes to degrade and/or otherwise become less effective. Additionally, vibration of the tubes in the condenser may reduce a flow of the cooling fluid through the tubes, which may decrease the amount of thermal heat transfer taking place, and thus reduce an efficiency of the condenser. Reducing vibration of the tubes may enable the condenser to maintain a flow of the cooling fluid and/or enhance the efficiency of the condenser.

Further, some embodiments of the condenser disclosed herein may include a passage lane (e.g., a gap or "dry" tubes) through the tubes. Such a passage lane may enable the refrigerant in the condenser to gain exposure to tubes that are positioned within a center portion of the condenser. Because such tubes may include cooling fluid at a lower temperature than tubes positioned near the edges of the condenser, exposing the refrigerant to centrally located tubes may increase an amount of thermal heat transfer occurring within the condenser, and thus, increase the efficiency of the condenser.

Figure 1:
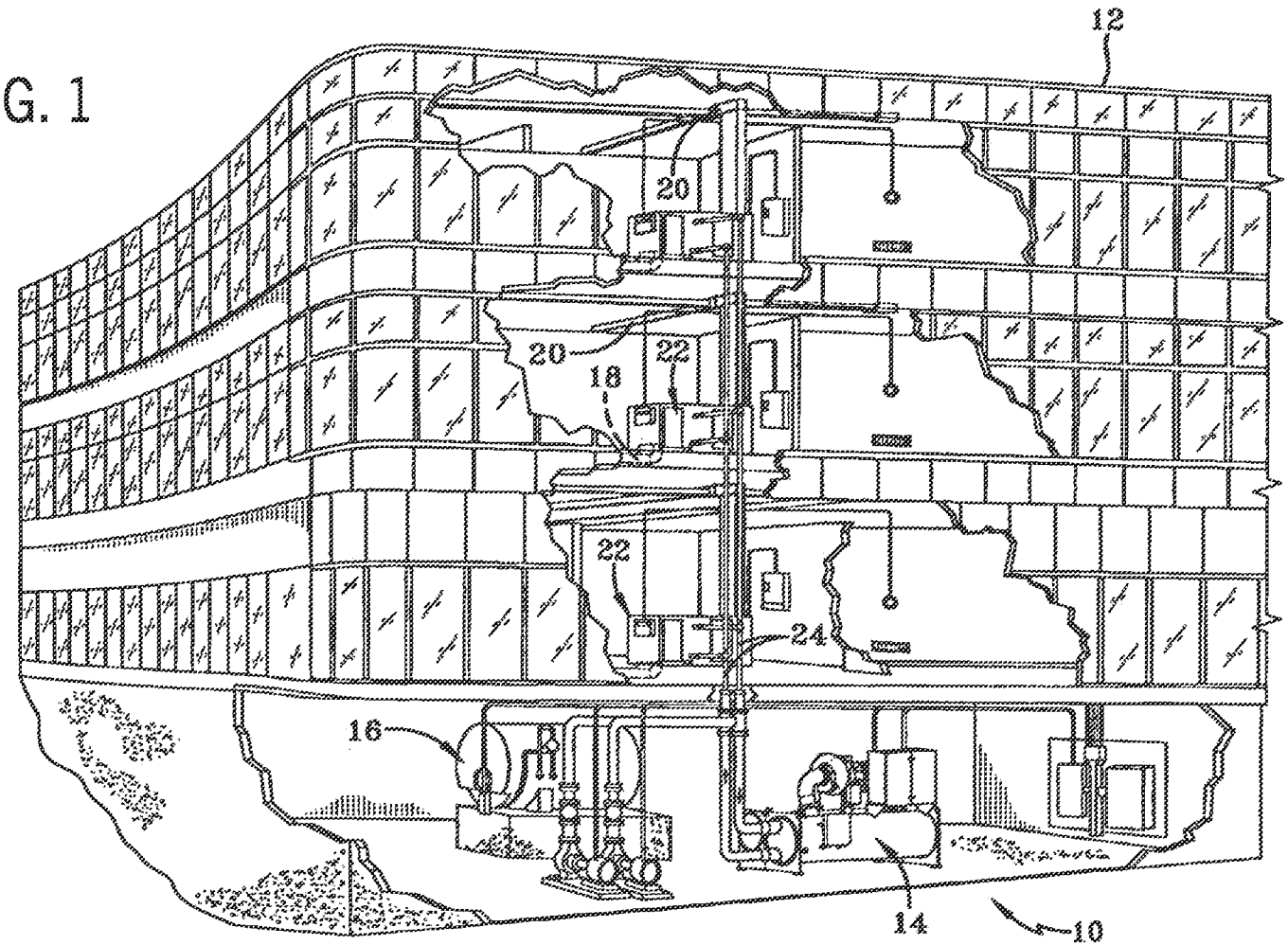
FIG. 1 is a perspective view of an embodiment of a building that may utilize a heating, ventilation, air conditioning, and refrigeration (HVAC&R) system in a commercial setting, in accordance with an aspect of the present disclosure.

Turning now to the drawings, FIG. 1 is a perspective view of an embodiment of an environment for a heating, ventilation, air conditioning, and refrigeration (HVAC&R) system 10 in a building 12 for a typical commercial setting. The HVAC&R system 10 may include a vapor compression system 14 that supplies a chilled liquid, which may be used to cool the building 12. The HVAC&R system 10 may also include a boiler 16 to supply warm liquid to heat the building 12 and an air distribution system which circulates air through the building 12. The air distribution system can also include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the HVAC&R system 10. The HVAC&R system 10 is shown with a separate air handler on each floor of building 12, but in other embodiments, the HVAC&R system 10 may include air handlers 22 and/or other components that may be shared between or among floors.

Figure 2:
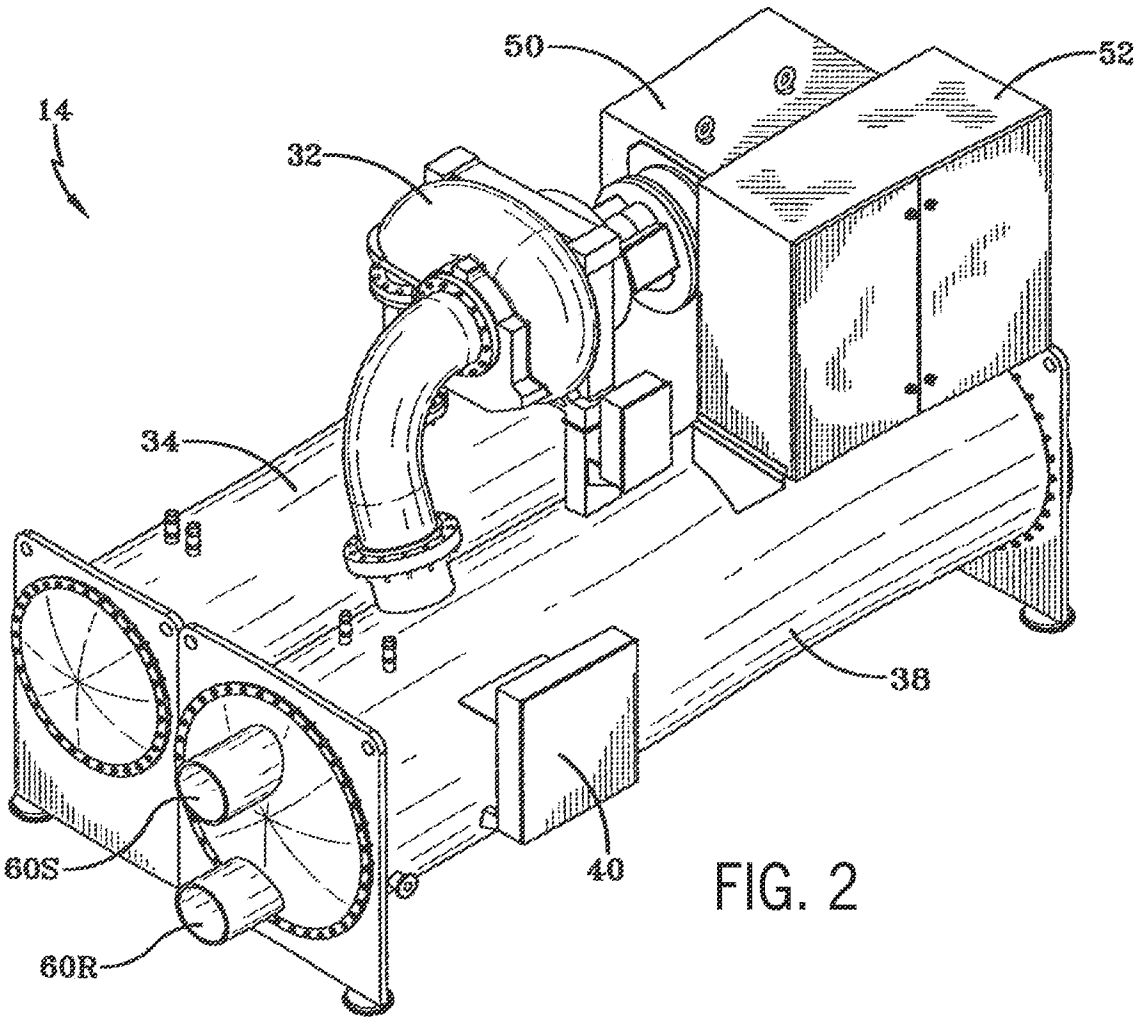
FIG. 2 is a perspective view of a vapor compression system, in accordance with an aspect of the present disclosure.
Figure 3:
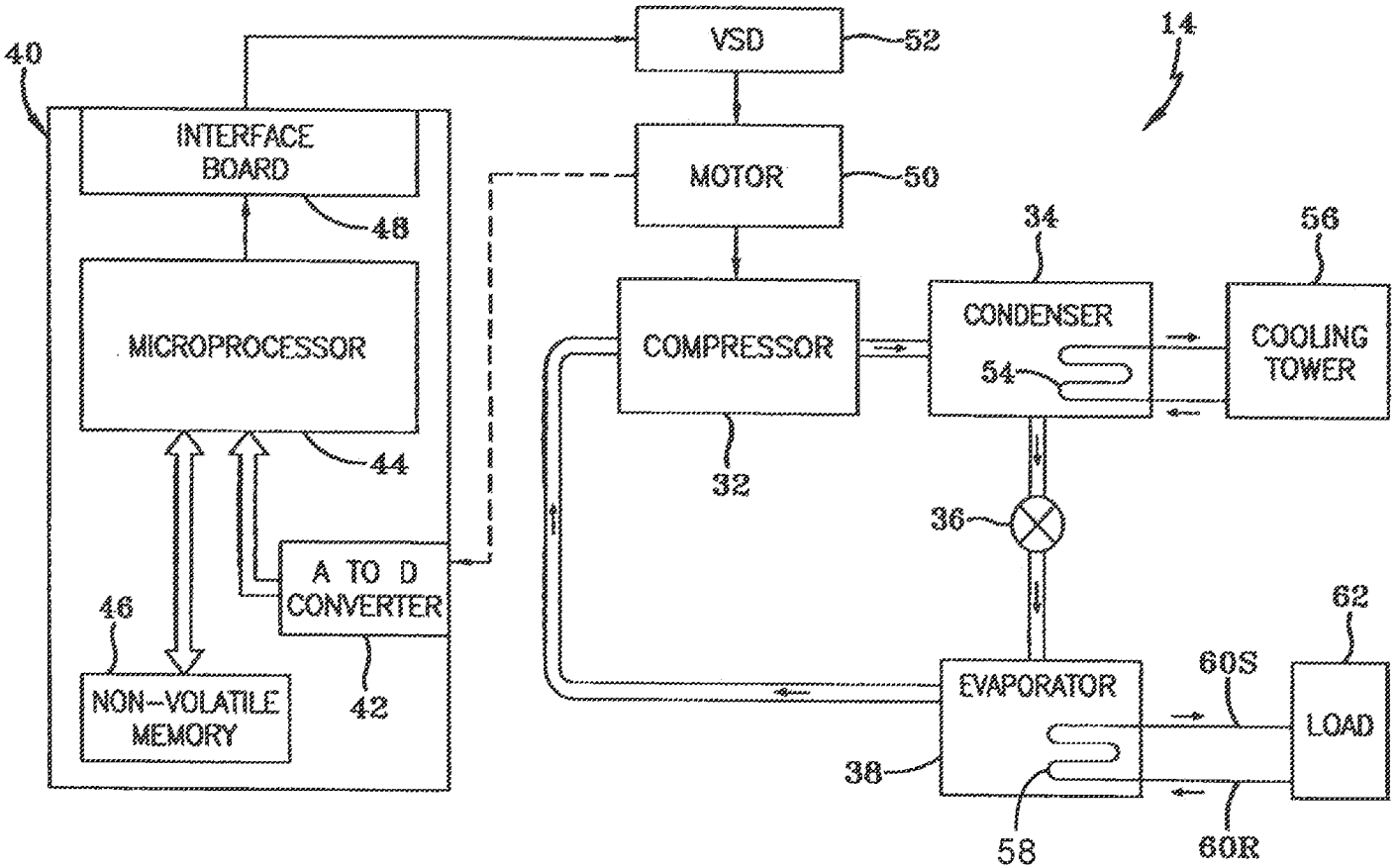
FIG. 3 is a schematic of an embodiment of the vapor compression system of FIG. 2, in accordance with an aspect of the present disclosure.

FIGS. 2 and 3 are embodiments of the vapor compression system 14 that can be used in the HVAC&R system 10. The vapor compression system 14 may circulate a refrigerant through a circuit starting with a compressor 32. The circuit may also include a condenser 34, an expansion valve(s) or device(s) 36, and a liquid chiller or an evaporator 38. The vapor compression system 14 may further include a control panel 40 that has an analog to digital (A/D) converter 42, a microprocessor 44, a non-volatile memory 46, and/or an interface board 48.

Some examples of fluids that may be used as refrigerants in the vapor compression system 14 are hydrofluorocarbon (HFC) based refrigerants, for example, R-410A, R-407, R-134a, hydrofluoro olefin (HFO), "natural" refrigerants like ammonia (NH3), R-717, carbon dioxide (CO2), R-744, or hydrocarbon based refrigerants, water vapor, or any other suitable refrigerant. In some embodiments, the vapor compression system 14 may be configured to efficiently utilize refrigerants having a normal boiling point of about 19 degrees Celsius (66 degrees Fahrenheit) at one atmosphere of pressure, also referred to as low pressure refrigerants, versus a medium pressure refrigerant, such as R-134a. As used herein, "normal boiling point" may refer to a boiling point temperature measured at one atmosphere of pressure.

In some embodiments, the vapor compression system 14 may use one or more of a variable speed drive (VSDs) 52, a motor 50, the compressor 32, the condenser 34, the expansion valve or device 36, and/or the evaporator 38. The motor 50 may drive the compressor 32 and may be powered by a variable speed drive (VSD) 52. The VSD 52 receives alternating current (AC) power having a particular fixed line voltage and fixed line frequency from an AC power source, and provides power having a variable voltage and frequency to the motor 50. In other embodiments, the motor 50 may be powered directly from an AC or direct current (DC) power source. The motor 50 may include any type of electric motor that can be powered by a VSD or directly from an AC or DC power source, such as a switched reluctance motor, an induction motor, an electronically commutated permanent magnet motor, or another suitable motor.

The compressor 32 compresses a refrigerant vapor and delivers the vapor to the condenser 34 through a discharge passage. In some embodiments, the compressor 32 may be a centrifugal compressor. The refrigerant vapor delivered by the compressor 32 to the condenser 34 may transfer heat to a cooling fluid (e.g., water or air) in the condenser 34. The refrigerant vapor may condense to a refrigerant liquid in the condenser 34 as a result of thermal heat transfer with the cooling fluid. The liquid refrigerant from the condenser 34 may flow through the expansion device 36 to the evaporator 38. In the illustrated embodiment of FIG. 3, the condenser 34 is water cooled and includes a tube bundle 54 connected to a cooling tower 56, which supplies the cooling fluid to the condenser.

The liquid refrigerant delivered to the evaporator 38 may absorb heat from another cooling fluid, which may or may not be the same cooling fluid used in the condenser 34. The liquid refrigerant in the evaporator 38 may undergo a phase change from the liquid refrigerant to a refrigerant vapor. As shown in the illustrated embodiment of FIG. 3, the evaporator 38 may include a tube bundle 58 having a supply line 60S and a return line 60R connected to a cooling load 62. The cooling fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. The evaporator 38 may reduce the temperature of the cooling fluid in the tube bundle 58 via thermal heat transfer with the refrigerant. The tube bundle 58 in the evaporator 38 can include a plurality of tubes and/or a plurality of tube bundles. In any case, the vapor refrigerant exits the evaporator 38 and returns to the compressor 32 by a suction line to complete the cycle.

Figure 4:
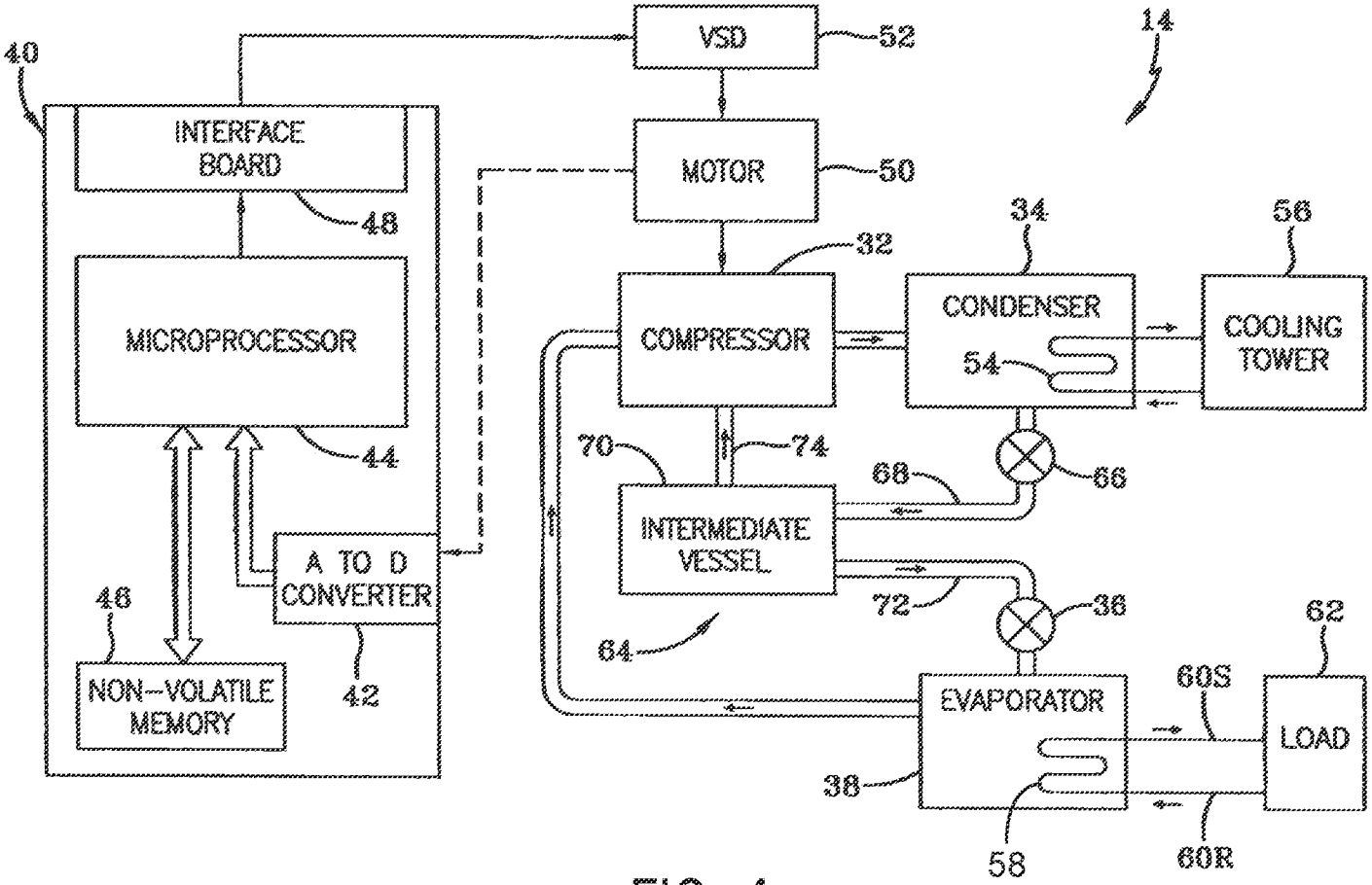
FIG. 4 is a schematic of an embodiment of the vapor compression system of FIG. 2, in accordance with an aspect of the present disclosure.

FIG. 4 is a schematic of the vapor compression system 14 with an intermediate circuit 64 incorporated between condenser 34 and the expansion device 36. The intermediate circuit 64 may have an inlet line 68 that is directly fluidly connected to the condenser 34. In other embodiments, the inlet line 68 may be indirectly fluidly coupled to the condenser 34. As shown in the illustrated embodiment of FIG. 4, the inlet line 68 includes a first expansion device 66 positioned upstream of an intermediate vessel 70. In some embodiments, the intermediate vessel 70 may be a flash tank (e.g., a flash intercooler). In other embodiments, the intermediate vessel 70 may be configured as a heat exchanger or a "surface economizer." In the illustrated embodiment of FIG. 4, the intermediate vessel 70 is used as a flash tank, and the first expansion device 66 is configured to lower the pressure of (e.g., expand) the liquid refrigerant received from the condenser 34. During the expansion process, a portion of the liquid may vaporize, and thus, the intermediate vessel 70 may be used to separate the vapor from the liquid received from the first expansion device 66. Additionally, the intermediate vessel 70 may provide for further expansion of the liquid refrigerant because of a pressure drop experienced by the liquid refrigerant when entering the intermediate vessel 70 (e.g., due to a rapid increase in volume experienced when entering the intermediate vessel 70). The vapor in the intermediate vessel 70 may be drawn by the compressor 32 through a suction line 74 of the compressor 32. In other embodiments, the vapor in the intermediate vessel may be drawn to an intermediate stage of the compressor 32 (e.g., not the suction stage). The liquid that collects in the intermediate vessel 70 may be at a lower enthalpy than the liquid refrigerant exiting the condenser 34 because of the expansion in the expansion device 66 and/or the intermediate vessel 70. The liquid from intermediate vessel 70 may then flow in line 72 through a second expansion device 36 to the evaporator 38.

FIGS. 5-10 are cross-sections of embodiments of the condenser 34 of the vapor compression system 14, illustrating a diffusion area 118 of the condenser 34. As used herein, the diffusion area 118 may be defined by a gap formed between tubes 120 of a tube bundle 122, a shell 80 of the condenser 34, and at least one opening 86 associated with a refrigerant distributor 76 (e.g., a channel or trough disposed in the shell 80 that may direct refrigerant from the compressor 32 into the condenser 34) and/or an opening 87 associated with the shell 80. In some embodiments, the diffusion area 118 substantially lacks the tubes 120 of the tube bundle 122. However, in other embodiments, one or more tubes 121 may optionally be positioned within the diffusion area 118 (see, e.g., FIG. 7). In still further embodiments, a plate or baffle may be included in the diffusion area 118 to further enhance distribution of the refrigerant 26 into the condenser 34. In any case, the diffusion area 118 may improve distribution of the refrigerant 26 from the compressor 32 that is passed over tubes 120 of the tube bundle 122 in the condenser 34, thereby increasing an amount of thermal heat transfer occurring in the condenser 34. In some embodiments, the diffusion area 118 may be tapered (e.g., substantially cone-shaped or V-shaped). In other embodiments, the diffusion area 118 may include another suitable shape. While the illustrated embodiments of FIGS. 5-10 illustrate the condenser 34 having the refrigerant distributor 76, in other embodiments, the condenser 34 may simply have an inlet defined by the opening 87 in the shell 80.

Figure 5:
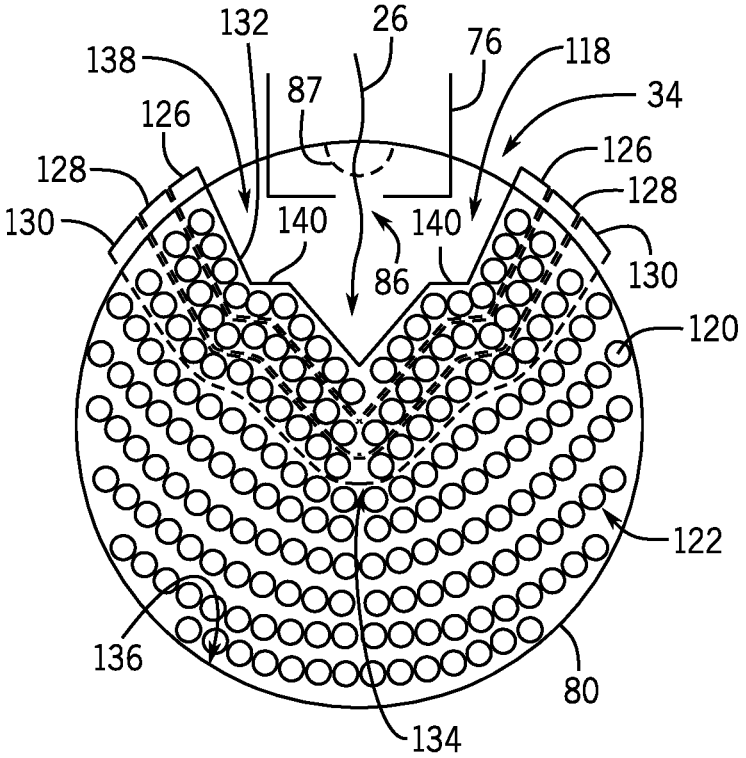
FIG. 5 is a cross section of an embodiment of a condenser of the vapor compression system of FIGS. 2-4 having a tapered diffusion area, in accordance with an aspect of the present disclosure.

As shown in the illustrated embodiment of FIG. 5, the tube bundle 122 may define one or more arrangements of layers or rows of tubes 120, such as rows 126, 128, and/or 130, with row 126 defining a perimeter 132 of the diffusion area 118. As shown in the illustrated embodiment of FIG. 5, the row 126 may define the perimeter 132 such that the perimeter 132 extends toward a center 134 of the shell 80. In some embodiments, the tubes 120 that are proximate to an interior wall 136 of the shell 80 may be exposed to the refrigerant 26 before the tubes 120 that are proximate the center 134. Accordingly, a temperature of the refrigerant 26 outside the tubes 120 proximate the interior wall 136 may be higher than the refrigerant 26 outside the tubes 120 proximate the center 134. Alternatively, the diffusion area 118 may enhance exposure of the refrigerant 26 to the tubes 120 proximate the center 134 of the shell 80, thereby increasing an amount of thermal energy transferred from the refrigerant 26 to the cooling fluid in the tubes 120. Accordingly, an efficiency of the condenser 34 may be enhanced by arranging the tubes 120 to form the diffusion area 118.

As shown in the illustrated embodiment of FIG. 5, the perimeter 132 of the diffusion area 118 may include a generally cone shape 138 (e.g., V shape) with one or more plateau portions 140. As shown in the illustrated embodiments of FIGS. 6-10, the perimeter 132 of the diffusion area 118 may include a variety of different shapes that extend toward the center 134 of the shell 80 at various distances. In any case, the diffusion area 118 may be configured to enable the refrigerant 26 entering the condenser 34 to be exposed to a greater number of tubes 120 at the top of the tube bundle, thereby increasing an amount of thermal heat transfer occurring in the condenser 34.

While the rows 126, 128, and 130 of the illustrated embodiment of FIG. 5 generally mirror a shape of the perimeter 132, in other embodiments the rows of tubes 126, 128, 130 may be positioned relative to one another along a straight line passing through respective centers of the tubes 120, or may be positioned relative to one another along a line that includes corners, curves, and/or other non-straight portions. In some embodiments, the tubes 120 of the tube bundle 122 may not include discernible rows (e.g., the tubes 120 and/or tube bundles 122 are arranged in a relatively random arrangement). The tubes 120 may be positioned in a fixed spacing arrangement, such that each of the tubes 120 are spaced equally apart from one another. However, in other embodiments, the tubes 120 may be positioned in a variable spacing arrangement, such that distances between tubes are different from one another. In still further embodiments, the tubes 120 may be positioned at least partially in a fixed spacing arrangement. As such, some of the tubes 120 may be spaced equally apart from one another, while other tubes 120 are spaced at different distances from one another. In any case, the tubes 120 may be arranged or positioned within the condenser 34 to increase an amount of thermal energy transfer between the refrigerant 26 flowing over the tubes 120 and the cooling fluid flowing through the tubes 120. As a result, an efficiency of the condenser 34 may be enhanced.

Figure 6:
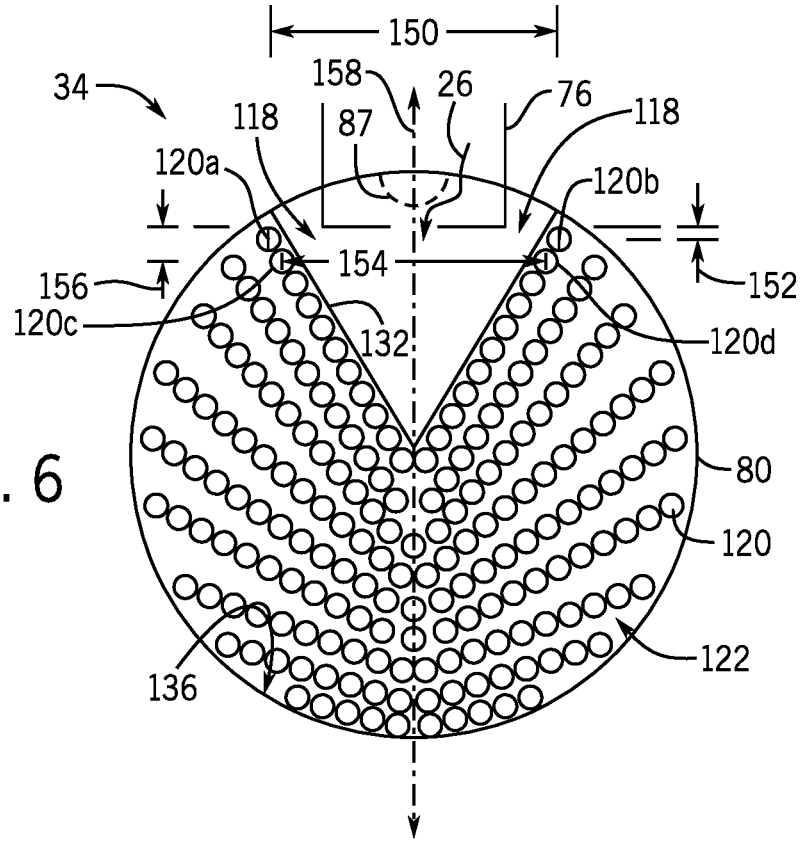
FIG. 6 is a cross section of an embodiment of the condenser of the vapor compression system of FIGS. 2-4 having a tapered diffusion area, in accordance with an aspect of the present disclosure.

As shown in FIG. 6, the diffusion area 118 is substantially tapered (e.g., cone-shaped or V-shaped) without the plateau portions 140. The diffusion area 118 illustrated in FIG. 6 may include a width 150 and a depth of 152 from refrigerant distributor 76 corresponding to tubes 120*a*, 120*b* (e.g., first and second tubes 120). As used herein, orientations of the width 150 and the depth 152 may be substantially perpendicular to each other, but are not limited to vertical and horizontal directions. In some embodiments, a ratio of the width 150 to the depth 152 (e.g., width 150 divided by depth 152) may be between 0.5 and 15, between 1 and 10, or between 2 and 9. The diffusion area 118 further has a width 154 and a depth 156 from refrigerant distributor 76 corresponding to tubes 120*c*, 120*d* (e.g., third and fourth tubes 120). In some embodiments, a ratio of the width 154 to the depth 156 (e.g., width 154 divided by depth 156) may be between 0.5 and 12, between 1 and 8, or between 2 and 5. Tubes 120*a*, 120*b*, 120*c*, and 120*d* define a portion or segment of the perimeter 132 of the diffusion area 118. In some embodiments, the width 150 is greater than the width 154, and the depth 156 is greater than the depth 152. In other words, the width of diffusion area 118 decreases as a result of increasing depth (e.g., the diffusion area 118 is tapered).

Figure 7:
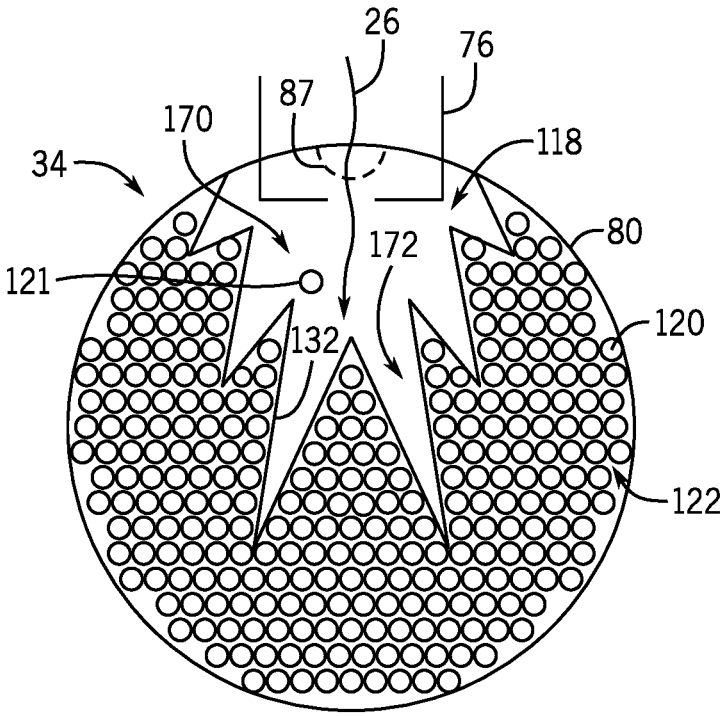
FIG. 7 is a cross section of an embodiment of the condenser of the vapor compression system of FIGS. 2-4 having a first tapered diffusion area and a second tapered diffusion area, in accordance with an aspect of the present disclosure.

While the illustrated embodiment of FIG. 6 shows the diffusion area 118 having the taper, in other embodiments, at least a portion of the diffusion area is not tapered relative to portion(s) of its width and depth. For example, at least a portion of the diffusion area can include a reverse taper. As shown in FIG. 6, the diffusion area 118 may be symmetric about a center axis 158 of the condenser 34. However, in other embodiments, the diffusion area 118 may include an asymmetric arrangement relative to the center axis 158. FIG. 7 shows diffusion area 118 having a primary or a first diffusion area 170 extending to a secondary or second diffusion area 172 (or multiple second diffusion areas 172) for providing improved distribution of refrigerant 26 from the compressor that is passed over the tubes 120 of the tube bundle 122 in the shell 80 of the condenser 34. As further shown in FIG. 7, both the primary or first diffusion area 170 and the secondary or second diffusion area 172 are tapered (e.g., cone shaped or V shaped).

Figure 8:
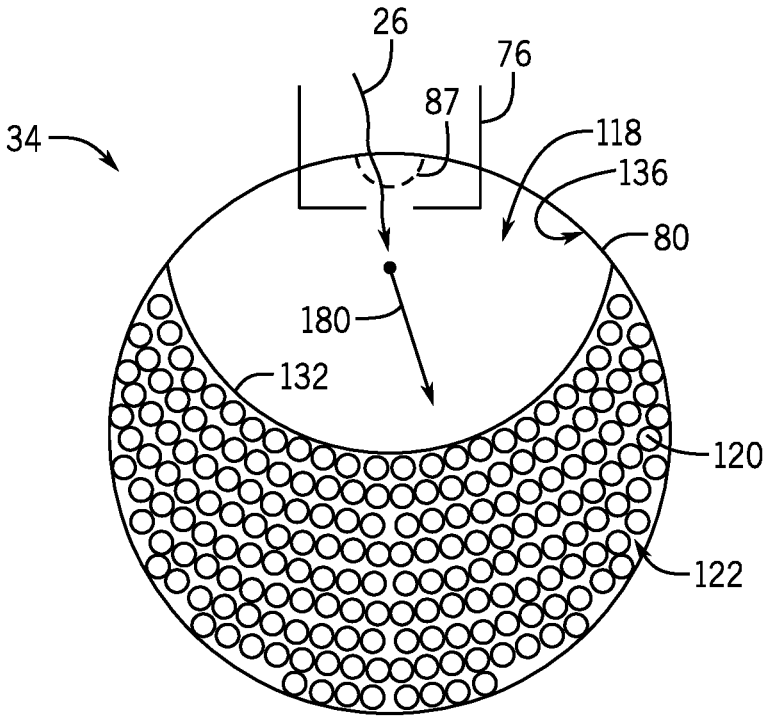
FIG. 8 is a cross section of an embodiment of a condenser of the vapor compression system of FIGS. 2-4 having a semi-circular diffusion area, in accordance with an aspect of the present disclosure.
Figure 9:
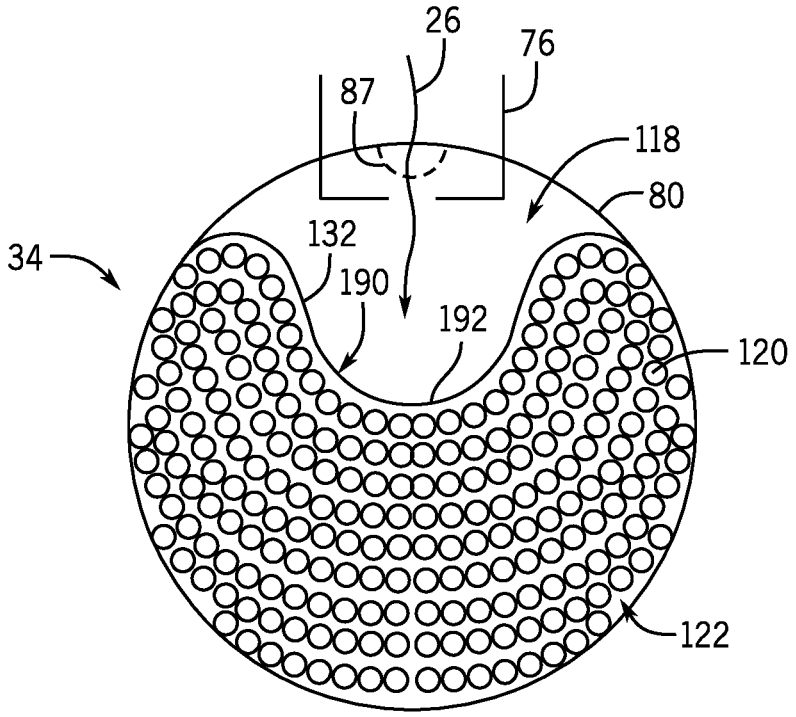
FIG. 9 is a cross section of an embodiment of a condenser of the vapor compression system of FIGS. 2-4 having a curved diffusion area with a single recessed portion, in accordance with an aspect of the present disclosure.
Figure 10:
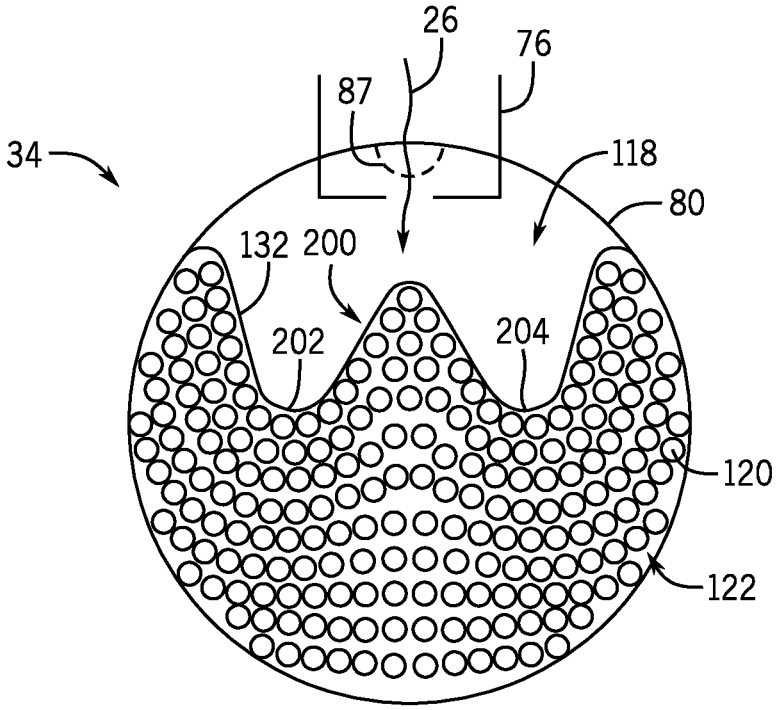
FIG. 10 is a cross section of an embodiment of a condenser of the vapor compression system of FIGS. 2-4 having a curved diffusion area having multiple recessed portions, in accordance with an aspect of the present disclosure.

Additionally, FIG. 8 is a cross section of an embodiment of the condenser 34, where the diffusion area 118 is substantially convex with respect to the interior surface 136 of the shell 80. For example, the diffusion area 118 may be semi-circular and include a radius 180. FIG. 9 is a cross section of an embodiment of the condenser 34 where the diffusion area 118 includes a curved perimeter 190 that includes a single recessed portion 192. However, in other embodiments, the diffusion area 118 may include a curved perimeter 200 that includes a first recessed portion 202 and a second recessed portion 204, as shown in FIG. 10. Including the multiple recessed portions 202 and 204 may reduce the number of tubes 120 in the shell 80, but increase an amount of tubes 120 at the top of the bundle which the refrigerant 26 contacts.

Figure 11:
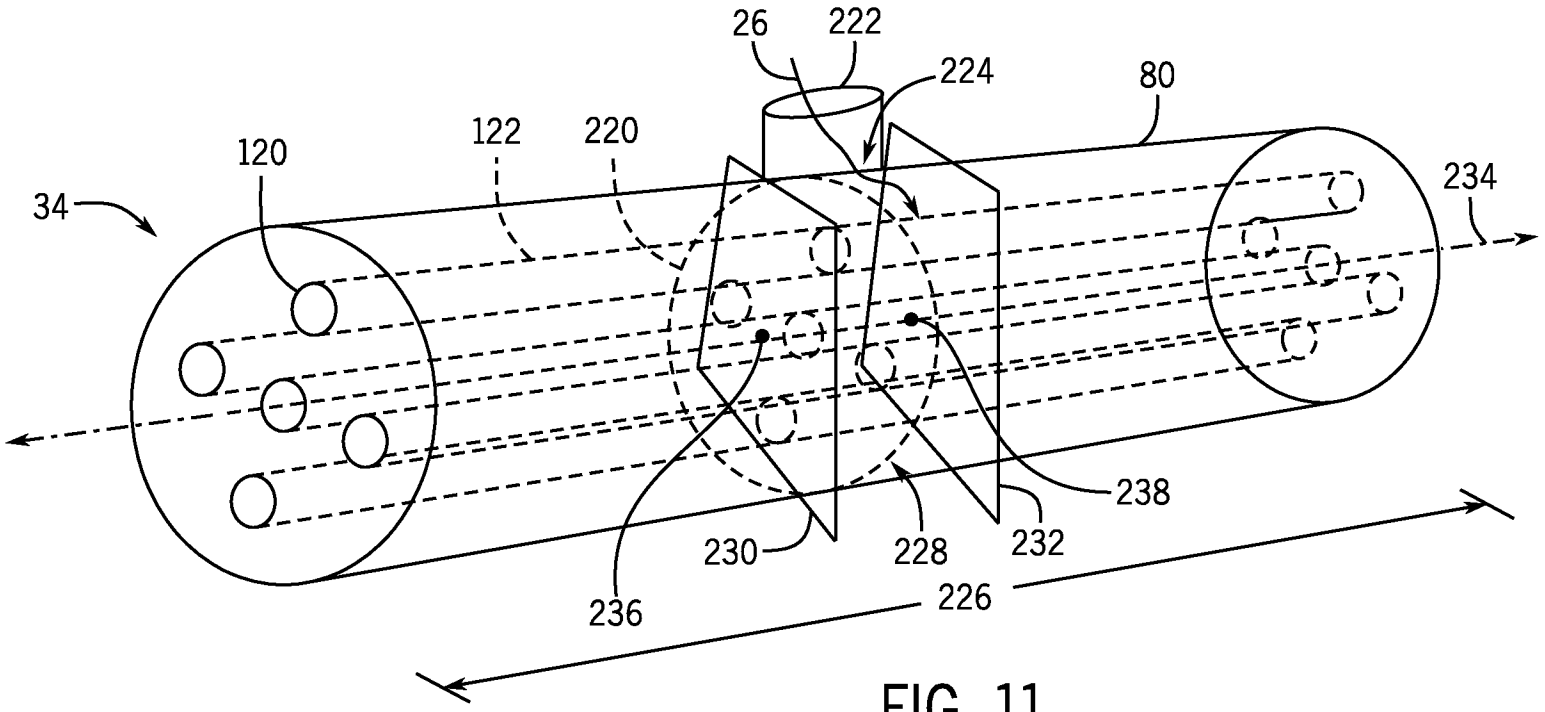
FIG. 11 is a perspective view of an embodiment of a condenser of the vapor compression system of FIGS. 2-4 having a tube plate, in accordance with an aspect of the present disclosure.

In addition to providing arrangements of the condenser 34 that increases thermal heat transfer, the present disclosure also provides for at least reducing, if not eliminating, vibration of the tubes 120 within the condenser 34. Such anti-vibration arrangements may be incorporated in any combination of the arrangements described above. For example, in the illustrated embodiments of FIGS. 5-10, the tubes 120 may include steel, copper, and/or another metallic material that has relatively high thermal conductance. Including a material with a relatively high conductance may enable the tubes 120 to have an increased wall thickness, thereby reducing vibrations that may be experienced by the tubes 120. In addition, a tube support plate 220 may be included in the condenser 34 to provide structural support to the tubes 120. For example, FIG. 11 is a perspective view of the condenser shell 80 that includes the tube support plate 220 through which at least one tube 120 of tube bundle 122 extends through. While the illustrated embodiment of FIG. 11 shows the tube plate 220 as being substantially circular and conforming to a cross-sectional area of the shell 80, in other embodiments, the tube plate 220 may include any suitable shape (e.g., a V-shape, an oval shape, a triangular shape, a square shape, a rectangular shape, a polygonal shape, etc.).

As shown in the illustrated embodiment of FIG. 11, the tube support plate 220 may be aligned with an inlet 222 formed in shell 80 of the condenser 34, which may provide improved vibration reduction of the tubes 120 of the tube bundle 122. For example, flow of the refrigerant 26 into the condenser 34 at the inlet 222 may be greater (e.g., more forceful) than a flow of the refrigerant 26 at other locations within the condenser 34 (e.g., due to a volume increase experienced when the refrigerant is within condenser 34). Accordingly, the flow of the refrigerant 26 entering the condenser 34 may be more likely to cause vibrations to the tubes 120. Thus, aligning the tube support plate 220 with the inlet 222 may provide structural support to the tubes 120 at the location of the condenser 34 where the tubes 120 are most likely to incur vibrations.

While the inlet 222 shown in FIG. 11 is positioned substantially at a midpoint 224 of a length 226 of the shell 80, in other embodiments, the inlet 222 and the tube support plate 220 (or multiple tube support plates) may be positioned at other locations along the length 226 of the shell 80. In still further embodiments, the tube support plate 220 may be misaligned with the inlet 222. For example, the tube support plate 220 may be positioned exterior of an inlet region 228, which may be defined as a section or volume of the shell 80 bound by a pair of planes 230 and 232 that are each generally perpendicular to a center axis 234 of the shell 80 and generally tangential to an outer diameter of the inlet 222. In some embodiments, each of the planes 230 and 232 are coincident with a respective point 236 and/or 238 that represents an intersection between an extension of the inlet 222 through the shell 80 and the center axis 234. In any case, the tube support plate 220 may be positioned at a predetermined location that may reduce vibrations of the tubes 120 during operation of the condenser 34.

Figure 12:
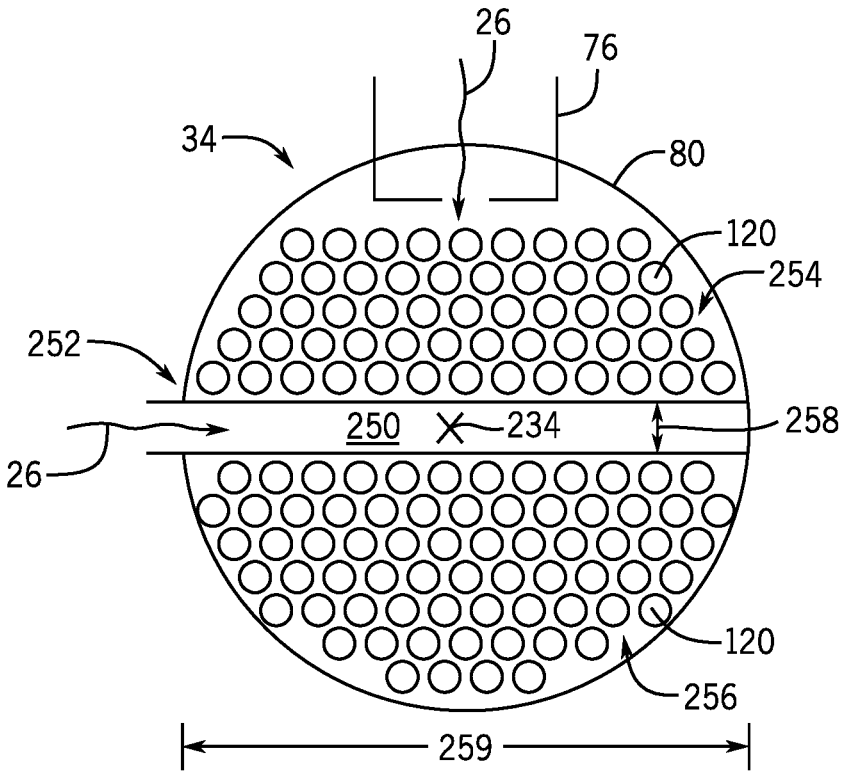
FIG. 12 is a cross section of an embodiment of a condenser of the vapor compression system of FIGS. 2-4 having a horizontal passage lane, in accordance with an aspect of the present disclosure.
Figure 13:
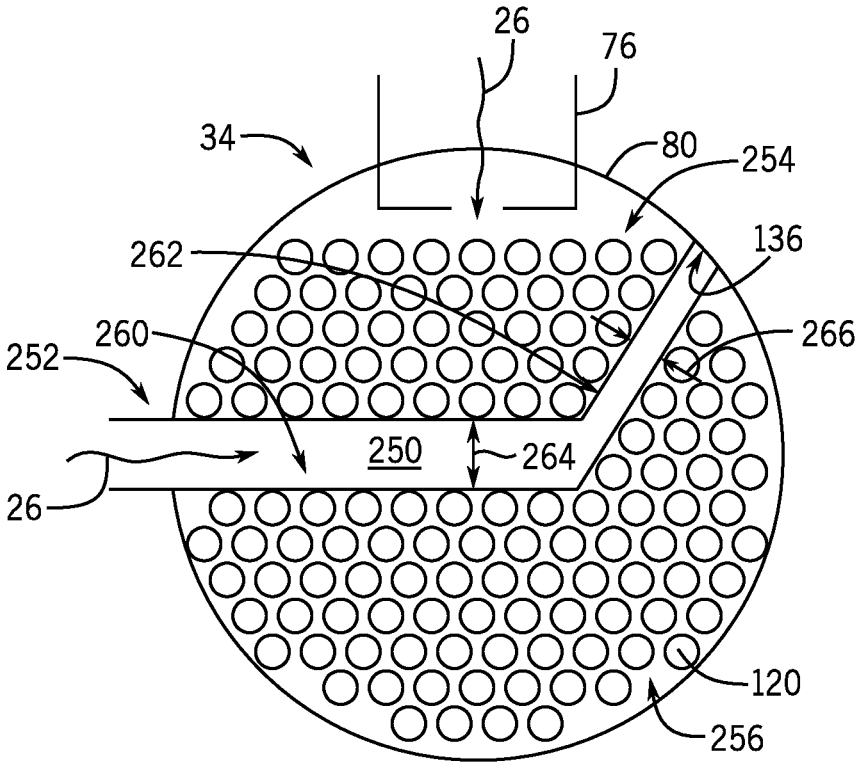
FIG. 13 is a cross section of an embodiment of a condenser of the vapor compression system of FIGS. 2-4 having a non-horizontal passage lane, in accordance with an aspect of the present disclosure.

FIGS. 12 and 13 are cross-sections of the condenser 34 having a passage lane 250 that may provide improved refrigerant 26 distribution within the condenser 34. As shown in the illustrated embodiment of FIG. 12, one or more inlets 252 (e.g., separate from the refrigerant distributor 76) directs vapor refrigerant (e.g., from the compressor 32) into the shell 80 and into the passage lane 250. The passage lane 250 may provide for broader and more uniform flow of the refrigerant 26 to the tubes 120 by splitting the tubes 120 into a first portion 254 and a second portion 256. Accordingly, the refrigerant 26 may be distributed into both the first portion 254 and the second portion 256 and contact tubes 120 in both portions 254 and 256. In some embodiments, a flow of the refrigerant 26 into the condenser 34 may be divided, such that the refrigerant 26 enters the condenser 34 through both the refrigerant distributor 76 and the one or more inlets 252. Division of the flow of the refrigerant 26 into the condenser may reduce a velocity of the refrigerant 26 that impacts the tubes 120, and thus reduces a force applied by the refrigerant 26 to the tubes 120, which may lead a reduction in tube vibration. Also, introducing the refrigerant 26 having a compressor discharge temperature (e.g., a temperature of the refrigerant 26 exiting the compressor 32) into the center 234 of the shell 80 may increase a temperature difference between the refrigerant 26 and the cooling fluid in the tubes 120 at the center 234 of the shell 80. The increased temperature difference may enhance heat transfer when compared to a condenser 34 without the passage lane 250 because a temperature difference between the refrigerant 26 and the tubes 120 at the center 234 would be lower due to cooling that would occur to the refrigerant 26 before reaching the tubes 120 at the center 234.

As shown in FIG. 12, the passage lane 250 is aligned with the opening 252 and extends between the tubes 120 disposed in the shell 80. In some embodiments, more than one passage lane 250 may extend between the tubes 120. Additionally, at least a portion of the passage lane 250 may be formed from dry tubes (e.g., tubes configured to substantially block the flow of cooling fluid therethrough). In such embodiments that include the dry tubes, tubular structures may be present in the passage lane 250, but no substantial amount of cooling fluid flows through them. As shown in the illustrated embodiment of FIG. 12, the passage lane 250 extends substantially horizontally within the shell 80 (e.g., the passage lane 250 extends along a plane that is substantially perpendicular to the center axis 234 of the shell 80). Additionally, a width 258 of the passage lane 250 is substantially constant through a diameter 259 of the shell 80.

However, in other embodiments, at least a portion of the passage lane 250 may extend in a non-horizontal direction within the shell 80, as shown in FIG. 13. The passage lane 250 of FIG. 13 may include a first portion 260 that extends into the shell 80 horizontally (e.g., the first portion 260 extends along a plane that is substantially perpendicular to the center axis 234 of the shell 80) and a second portion 262 that extends through the shell 80 in a non-horizontally (e.g., the second portion 262 does not extend along a plane that is perpendicular to the center axis 234). In some embodiments, the first portion 260 may include a first width 264 and the second portion 262 may include a second width 266, different from the first width 264. As shown in the illustrated embodiment, the first width 264 is larger than the second width 266. However, in other embodiments, the second width 266 may be larger than the first width 264 or the first width 264 and the second width 266 may be substantially equal.

While the embodiments of FIGS. 12 and 13 show the passage lane 250 extending entirely across the shell 80, in other embodiments, the passage lane 250 may stop within the shell 80, such that the passage lane 250 does not contact the interior surface 136 of the shell 80 at both ends. In any case, the refrigerant 26 may generally flow more freely through the passage lane 250 when compared to more closely spaced tubes 120. As a result, the distribution of heated vapor refrigerant within the condenser 34 is improved by enabling a portion of the refrigerant 26 to contact tubes 120 spaced further away from the inlet 252. Accordingly, an overall efficiency of the condenser 34 may be improved. In addition, the passage lane 250 may reduce resistance to a flow of the refrigerant 26, thereby similarly reducing an amount of pressure drop associated with the refrigerant 26 in the condenser 34, which may further increase system operating efficiency.

While only certain features and embodiments have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described (i.e., those unrelated to the presently contemplated best mode of carrying out the disclosure, or those unrelated to enabling the claimed disclosure). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A vapor compression system, comprising:

a refrigerant loop;

a compressor disposed along the refrigerant loop and configured to circulate a refrigerant through the refrigerant loop;

a condenser disposed downstream of the compressor along the refrigerant loop, wherein the condenser is configured to receive the refrigerant through a first inlet and a second inlet of the condenser, wherein the first inlet is disposed above the second inlet relative to a vertical dimension of the condenser, wherein the condenser comprises a plurality of tubes disposed within a shell of the condenser, wherein the condenser comprises a passage lane configured to enhance thermal energy transfer within the condenser, wherein the passage lane is aligned with and extends from the second inlet through the shell of the condenser to form a gap between a first tube bundle and a second tube bundle of the plurality of tubes, wherein the passage lane extends horizontally through the shell of the condenser and extends across a diameter of the shell from a first diametric point of the shell to a second diametric point of the shell, and wherein the gap of the passage lane comprises a length that is greater than a tube diameter of a tube of the plurality of tubes; and an evaporator disposed downstream of the condenser along the refrigerant loop.

2. The vapor compression system of claim 1, wherein the condenser comprises a single tube plate disposed between axial ends of the shell and configured to receive and support at least one tube of the plurality of tubes to reduce vibrations of the at least one tube, and wherein the condenser does not include an additional tube plate between the axial ends of the shell.

3. The vapor compression system of claim 1, wherein the condenser comprises a distributor trough extending into and axially along a diffusion area of the condenser.

4. The vapor compression system of claim 3, wherein the distributor trough is configured to receive a portion of the refrigerant from the first inlet.

5. The vapor compression system of claim 4, wherein the distributor trough comprises an axially oriented channel or plurality of openings formed in a collection surface of the distributor trough and configured to enable distribution of the portion of the refrigerant to the diffusion area.

6. The vapor compression system of claim 1, wherein at least a portion of a boundary of the passage lane is defined by a plurality of dry tubes of the first tube bundle, the second tube bundle, or both, wherein the plurality of dry tubes is configured to block refrigerant flow therethrough.

7. The vapor compression system of claim 1, comprising an intermediate vessel positioned between the condenser and the evaporator.

8. The vapor compression system of claim 7, wherein the intermediate vessel comprises a flash tank.

9. The vapor compression system of claim 7, wherein the intermediate vessel comprises a surface economizer.

10. The vapor compression system of claim 1, comprising at least one expansion device positioned between the condenser and the evaporator.

* * * * *